US011569592B1

(12) United States Patent
Williams

(10) Patent No.: US 11,569,592 B1
(45) Date of Patent: Jan. 31, 2023

(54) QUICK CONNECT TERMINAL ASSEMBLY

(71) Applicant: Cole Williams, Plainview, TX (US)

(72) Inventor: Cole Williams, Plainview, TX (US)

( * ) Notice: Subject to any disclaimer, the term of this patent is extended or adjusted under 35 U.S.C. 154(b) by 0 days.

(21) Appl. No.: 17/508,305

(22) Filed: Oct. 22, 2021

(51) Int. Cl.
*H01R 4/48* (2006.01)
*H01R 11/12* (2006.01)

(52) U.S. Cl.
CPC ..... *H01R 4/4818* (2013.01); *H01R 11/12* (2013.01)

(58) Field of Classification Search
CPC ..... H01R 4/4818; H01R 11/12
See application file for complete search history.

(56) References Cited

U.S. PATENT DOCUMENTS 2,720,634 A 10/1955 Hart
3,368,187 A * 2/1968 Faul ..... H01R 11/24 439/829
3,487,356 A * 12/1969 David ..... H01R 25/00 439/861
3,993,389 A * 11/1976 Deitch ..... H01R 24/58 439/502
4,084,876 A 4/1978 Dinger
4,700,997 A * 10/1987 Strand ..... A61B 5/274 439/372
7,568,939 B2 8/2009 Dickmann
10,741,939 B1 * 8/2020 Nikolopoulos .... H01R 13/5025
11,316,288 B2 * 4/2022 Urbaniak ..... H01R 13/506

* cited by examiner

*Primary Examiner* — Travis S Chambers

(57) ABSTRACT

A quick connect terminal assembly for attaching a conductor to an electrical circuit includes a terminal which can be attached to an electrical circuit. A retainer engages the terminal which defines a conductor space between the retainer and the terminal. The conductor space insertably receives an end of a conductor. The retainer is biased toward the terminal to compress the conductor between the terminal and the retainer. Each of the retainer and the terminal is comprised of an electrically conductive material to facilitate electrical communication between the conductor and the electrical circuit. A sheath is positioned around the terminal and the retainer to inhibit electrical communication between the conductor and external objects.

14 Claims, 4 Drawing Sheets

QUICK CONNECT TERMINAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to terminal devices and more particularly pertains to a new terminal device for attaching a conductor to an electrical circuit. The device includes a terminal which has a curved portion and a retainer that is engaged to the terminal. The retainer is spaced from the terminal to define a conductor space between the terminal and the retainer. Additionally, a sheath is positioned around the terminal and the retainer. The curved portion of the terminal and the retainer abuts the conductor when the conductor is inserted into the conductor space to place the conductor into electrical communication with the electrical circuit.

(2) Description of Related Art Including Information Disclosed Under 37 CFR 1.97 and 1.98

The prior art relates to terminal devices including a crimpless electrical connector that includes a terminal and a flap that is spaced from the terminal. A conductor is insertable between the terminal and the flap having the flap engaging the conductor at an angle to inhibit the conductor from being removed from the crimpless electrical connector. The prior art discloses a wire coupler that includes a pair of fingers that receive a first conductor and a socket that receives a second conductor for placing the first conductor into electrical communication with the second conductor. The prior art discloses a wire splice that includes a pair of opposing sockets, each having a tab being integrated therein, which each insertably receives a respective one of a pair of wires for splicing the pair of wires together. The prior art discloses a terminal block which has a socket for insertably receiving a conductor and a plurality of contacts in the terminal block.

BRIEF SUMMARY OF THE INVENTION

An embodiment of the disclosure meets the needs presented above by generally comprising a terminal which can be attached to an electrical circuit. A retainer engages the terminal which defines a conductor space between the retainer and the terminal. The conductor space insertably receives an end of a conductor. The retainer is biased toward the terminal to compress the conductor between the terminal and the retainer. Each of the retainer and the terminal is comprised of an electrically conductive material to facilitate electrical communication between the conductor and the electrical circuit. A sheath is positioned around the terminal and the retainer to inhibit electrical communication between the conductor and external objects.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
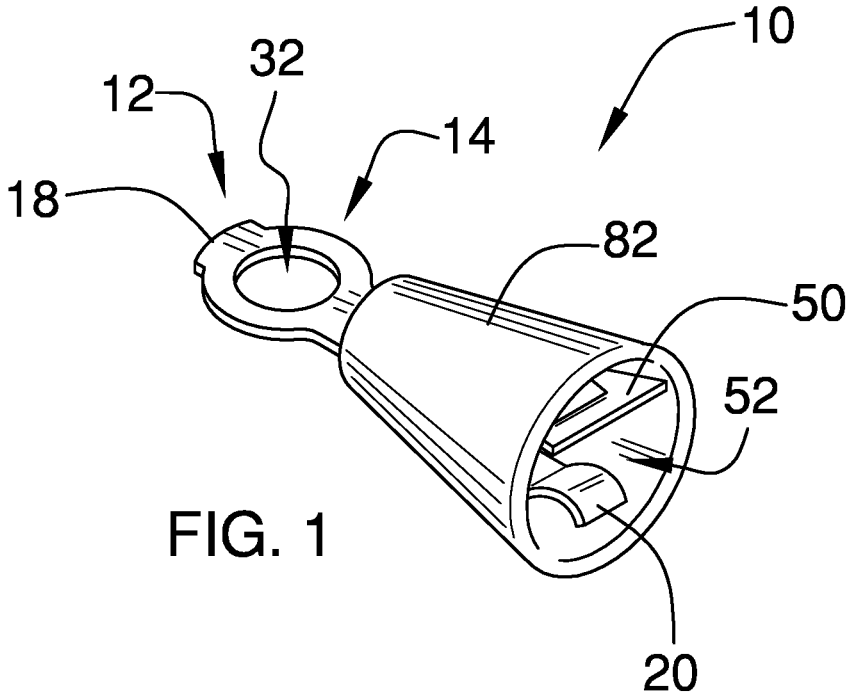
FIG. 1 is a perspective view of a quick connect terminal assembly according to an embodiment of the disclosure.
Figure 2:
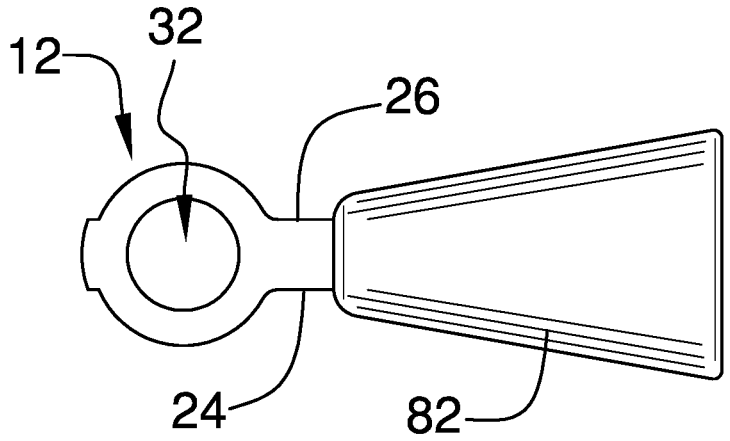
FIG. 2 is a top view of an embodiment of the disclosure.
Figure 3:
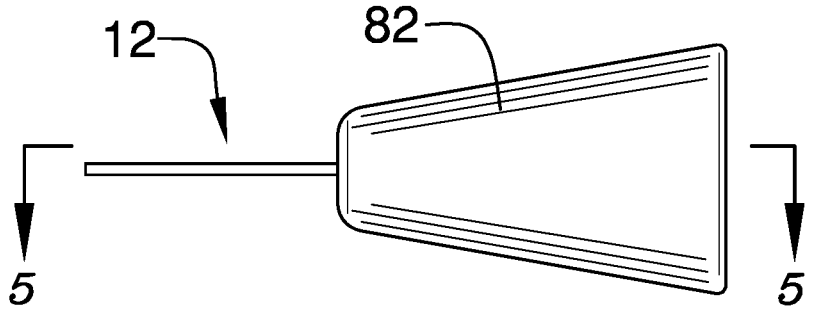
FIG. 3 is a right side view of an embodiment of the disclosure.
Figure 4:
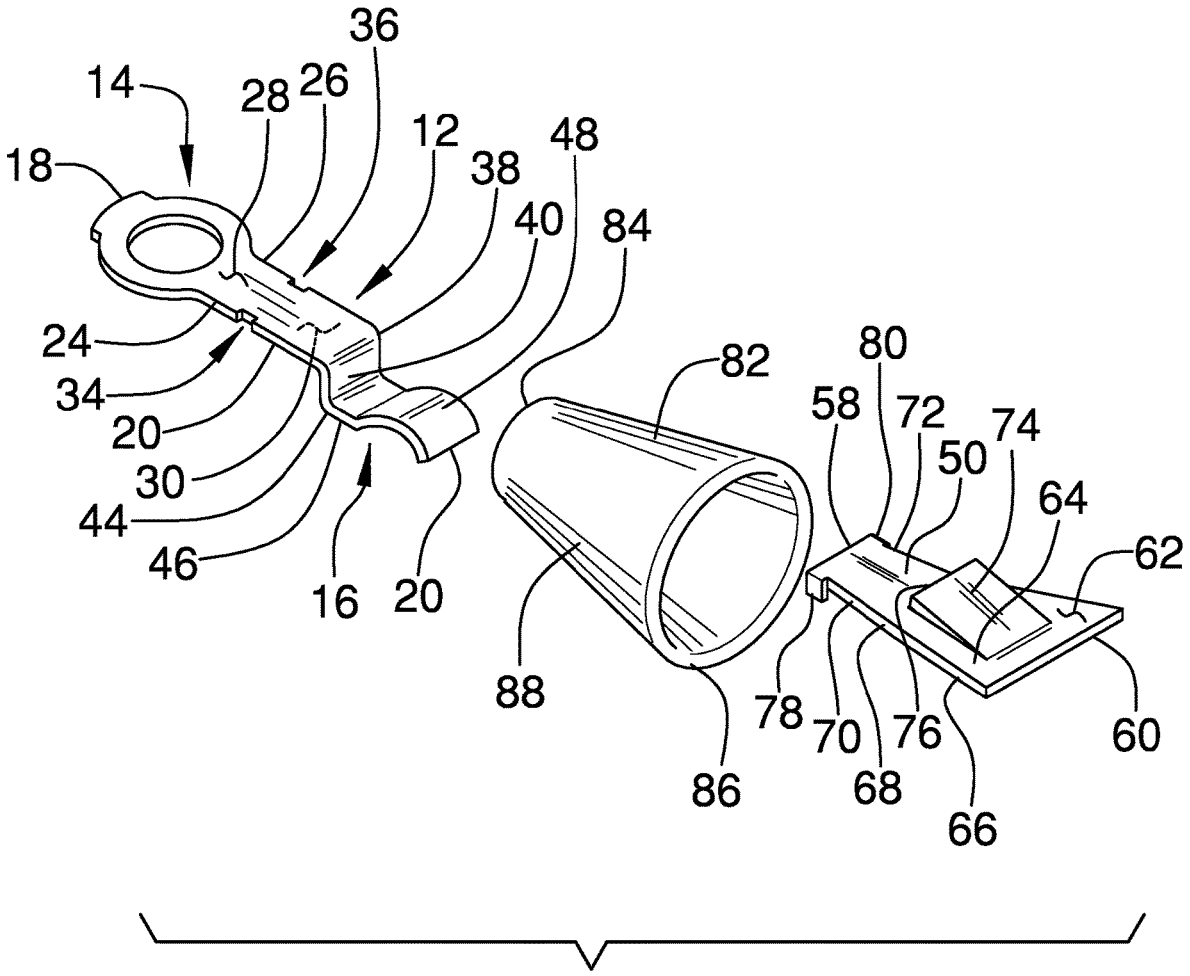
FIG. 4 is an exploded perspective view of an embodiment of the disclosure.
Figure 5:
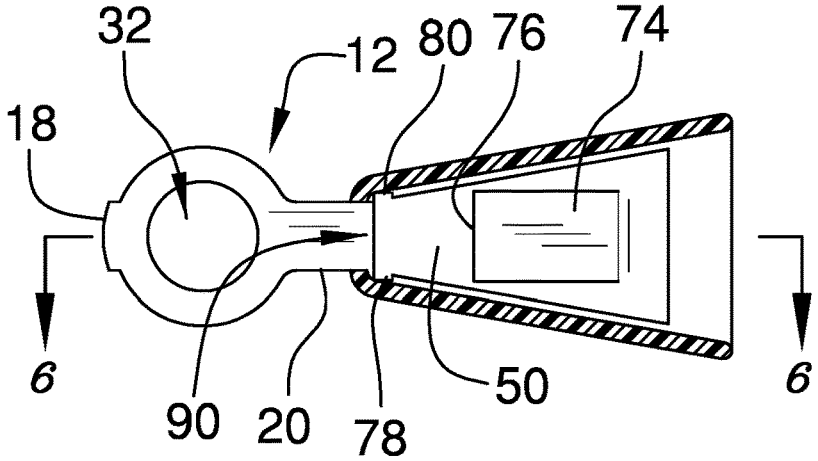
FIG. 5 is a top cut-away view of an embodiment of the disclosure.
Figure 6:
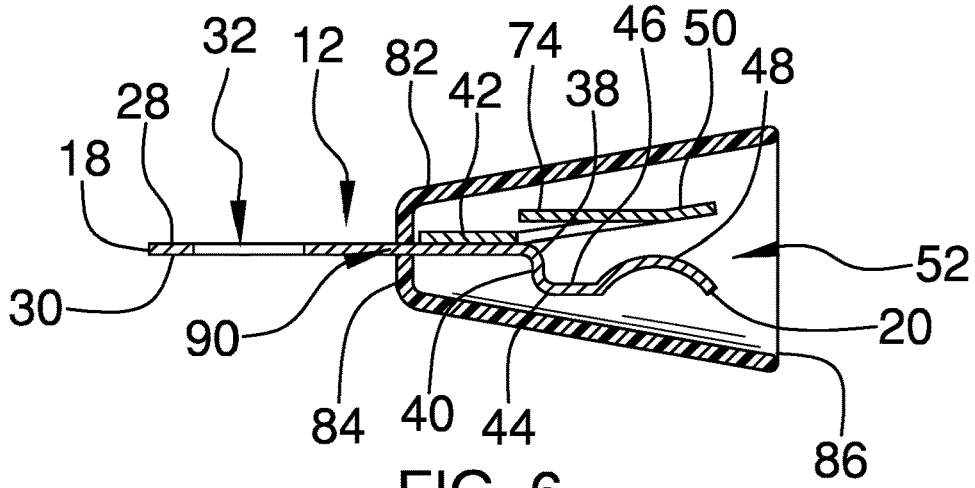
FIG. 6 is a cross sectional view taken along line 6-6 of FIG. 5 of an embodiment of the disclosure.
Figure 7:
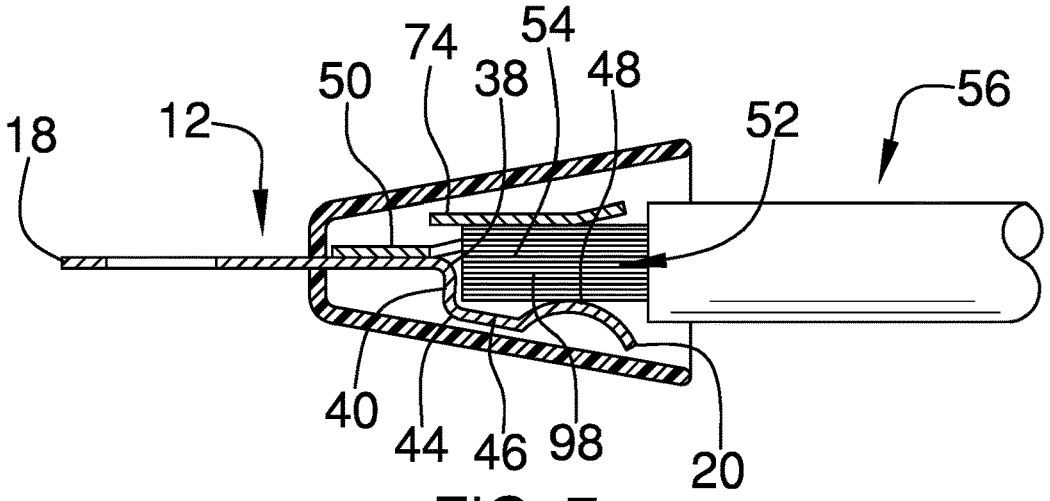
FIG. 7 is a cross sectional view taken along line 6-6 of FIG. 5 of an embodiment of the disclosure showing a conductor being inserted into a conductor space.

With reference now to the drawings, and in particular to FIGS. 1 through 8 thereof, a new terminal device embodying the principles and concepts of an embodiment of the disclosure and generally designated by the reference numeral 10 will be described.

As best illustrated in FIGS. 1 through 8, the quick connect terminal assembly 10 generally comprises a terminal 12 that has a connection point 14 integrated into the terminal 12.

The connection point 14 can be attached to an electrical circuit, which might include a post of an electrical component of a vehicle electrical system, for example. The terminal 12 has a curved portion 16 that is distally positioned with respect to the connection point 14. The terminal 12 has a first end 18, a second end 20 and an outer edge 22 extending between the first end 18 and the second end 20. Moreover, the terminal 12 is elongated between the first end 18 and the second end 20, and the outer edge 22 has a first lateral side 24 and a second lateral side 26. The terminal 12 has a top surface 28 and a bottom surface 30 each extending between the first end 18 and the second end 20.

The terminal 12 has an opening 32 extending between the top surface 28 and the bottom surface 30 such that the opening 32 defines the connection point 14. The opening 32 is positioned adjacent to the first end 18, and each of the first lateral side 24 and the second lateral side 26 curves outwardly from an axis extending between the first end 18 and the second end 20 at a point that is aligned with the opening 32. The first lateral side 24 has a first slot 34 extending toward the second lateral side 26 and the first slot 34 is positioned between the opening 32 and the second end 20. The second lateral side 26 has a second slot 36 extending toward the first lateral side 24 and the second slot 36 is aligned with the first slot 34.

The curved portion 16 includes a first bend 38 defining a vertical portion 40 of the terminal 12 that is perpendicularly oriented with a first horizontal portion 42 of the terminal 12. The first bend 38 is positioned between the first slot 34, the second slot 36 and the second end 20 of the terminal 12. Continuing, the curved portion 16 includes a second bend 44 which defines a second horizontal portion 46 which is perpendicularly oriented with the vertical portion 40. The second horizontal portion 46 lies on a plane that is oriented parallel with the first horizontal portion 42. The curved portion 16 includes a curve 48 extending between the second horizontal portion 46 and the second end 20, and the curve 48 extends upwardly from the second horizontal portion 46.

A retainer 50 is provided which engages the terminal 12 having the retainer 50 being spaced from the terminal 12 to define a conductor space 52 between the retainer 50 and the terminal 12. Moreover, the conductor space 52 insertably receives an end 54 of a conductor 56. The conductor 56 may be an insulated electrical wire that has insulation stripped away to expose wires of the electrical wire which may be wires of any conventional American wire gauge. The retainer 50 is biased toward the terminal 12 to compress the conductor 56 between the terminal 12 and the retainer 50. Each of the retainer 50 and the terminal 12 is comprised of an electrically conductive material to facilitate electrical communication between the conductor 56 and the electrical circuit.

The retainer 50 has a primary end 58, a secondary end 60 and an exterior surface 62 extending between the primary end 58 and the secondary end 60. The exterior surface 62 has an upper side 64 and a lower side 66, and the retainer 50 has an outside edge 68 extending between the primary end 58 and the secondary end 60. The outside edge 68 has a first sidelong side 70 and a second sidelong side 72. The retainer 50 has a flap 74 that is integrated into the upper side 64 and the lower side 66 of the exterior surface 62, and the flap 74 extends upwardly from the upper side 64. Furthermore, the flap 74 has a free end 76 that is directed toward the primary end 58 of the retainer 50.

Each of the first sidelong side 70 and the second sidelong side 72 angling outwardly between the primary end 58 and the secondary end 60 such that the secondary end 60 has a width is greater than a width of the primary end 58. The retainer 50 has a first tab 78 extending downwardly from the first sidelong side 70 and the first tab 78 is positioned adjacent to the primary end 58. The retainer 50 has a second tab 80 extending downwardly from the second sidelong side 72 and the second tab 80 is positioned adjacent to the primary end 58. Each of the first tab 78 and the second tab 80 engages a respective one of the first slot 34 and the second slot 36 having the retainer 50 sloping upwardly from the terminal 12.

A sheath 82 is provided and the sheath 82 is positioned around the terminal 12 and the retainer 50. The sheath 82 surrounds the conductor 56 when the conductor 56 is inserted into the conductor space 52. The sheath 82 is comprised of an electrically insulating material to inhibit electrical communication between the conductor 56 and external objects.

The sheath 82 has a front end 84, a back end 86 and an outside wall 88 extending between the front end 84 and the back end 86. The outside wall 88 is continuously arcuate about an axis extending between the front end 84 and the back end 86 such that the sheath 82 has a cylindrical shape. The outside wall 88 flares outwardly between the front end 84 and the back end 86 such that the back end 86 has a diameter that is greater than a diameter of the front end 84. The back end 86 is open and the front end 84 has a slot 90 extending through the front end 84. The terminal 12 extends through the slot 90 having the connection point 14 being exposed with respect to the sheath 82. Moreover, the second end 20 of the terminal 12 and the secondary end 60 of the retainer 50 is positioned within the sheath 82.

Figure 8:
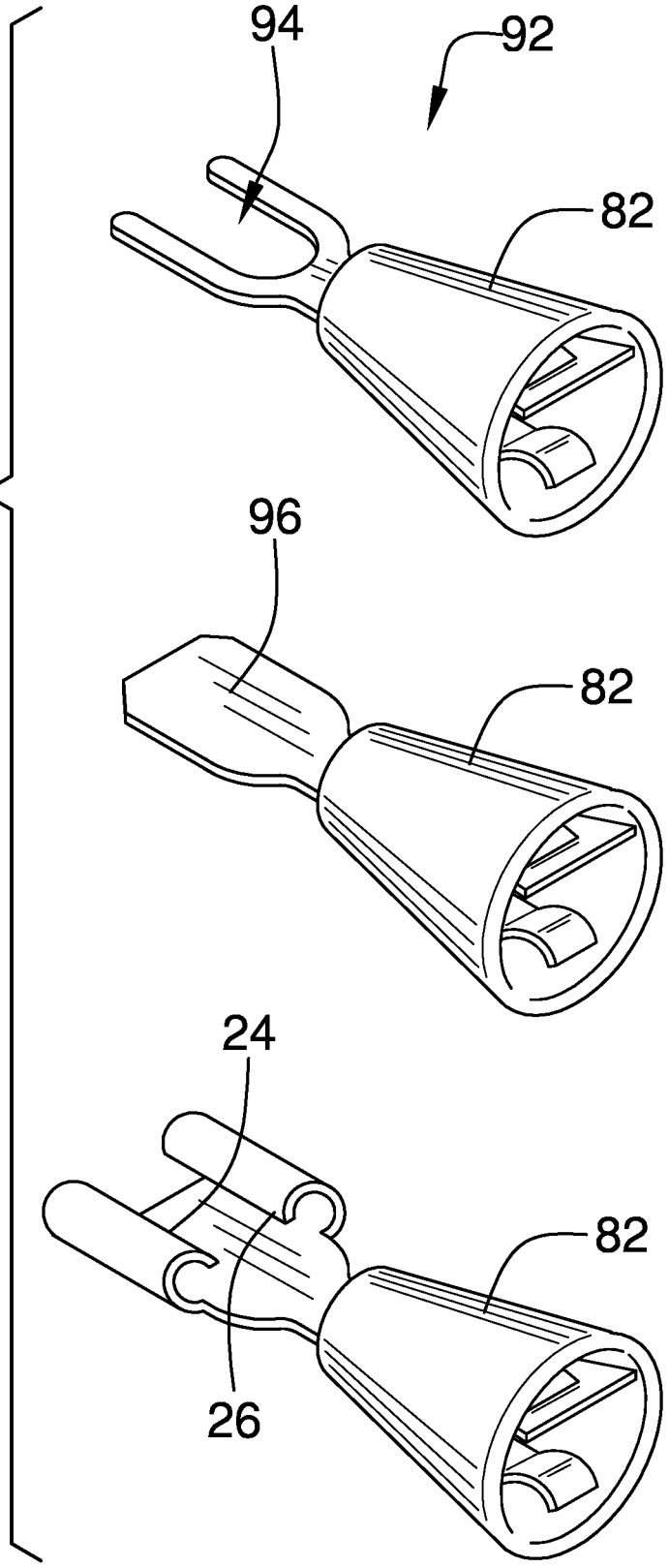
FIG. 8 is a perspective view of an alternative embodiment of the disclosure.

In alternative embodiment 92 as is most clearly shown in FIG. 8, the first end 18 of the terminal 12 may have a slot 94 extending toward the second end 20 of the terminal 12 to accommodate a post of an electrical connection. Continuing in the alternative embodiment 92, the first end 18 of the terminal 12 is flattened into a spade 96 for inserting into a female electrical connection. Additionally in the alternative embodiment 92, the terminal 12 curls onto the to the top surface 28 along each of the first lateral side 24 and the second lateral side 26 of the outer edge 22 of the terminal 12 at a point located adjacent to the first end 18 of the terminal 12 to slidably receive a spade of an electrical connection.

In use, the conductor 56 is inserted into the back end 86 of the sheath 82 such that exposed wires 98 of the conductor 56 slide into the conductor space 52 defined between the terminal 12 and the retainer 50. In this way the exposed wires 98 abuts the curve 48 on the terminal 12 and the flap 74 on the retainer 50 such that the exposed wires 98 are in electrical communication with the terminal 12 and the retainer 50. Furthermore, the terminal 12 is urged downwardly from the retainer 50 and the retainer 50 is urged upwardly from the terminal 12 when the exposed wires 98 are inserted into the conductor space 52. In this way the terminal 12 and the retainer 50 are compressed against the exposed wires 98 to inhibit the exposed wires 98 from being pulled outwardly from the conductor space 52. Additionally, the flap 74 is urged upwardly by the exposed wires 98 such that the flap 74 compresses against the exposed wires 98 to further secure the exposed wires 98 in the conductor space 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A quick connect terminal assembly for forming an electrical connection with a conductor with being crimped, said assembly comprising:

a terminal having a connection point integrated into said terminal wherein said connection point is configured to be attached to an electrical circuit, said terminal having a curved portion being distally positioned with respect to said connection point;

a retainer engaging said terminal having said retainer being spaced from said terminal to define a conductor space between said retainer and said terminal wherein said conductor space is configured to insertably receive an end of a conductor, said retainer being biased toward said terminal wherein said retainer is configured to compress the conductor between said terminal and said retainer, each of said retainer and said terminal being comprised of an electrically conductive material wherein each of said retainer and said terminal is configured to facilitate electrical communication between the conductor and the electrical circuit; and a sheath being positioned around said terminal and said retainer wherein said sheath is configured to surround the conductor when the conductor is inserted into said conductor space, said sheath being comprised of an electrically insulating material wherein said sheath is configured to inhibit electrical communication between the conductor and external objects.

2. The assembly according to claim 1, wherein:

said terminal has a first end, a second end and an outer edge extending between said first end and said second end, said terminal being elongated between said first end and said second end, said outer edge having a first lateral side and a second lateral side, said terminal having a top surface and a bottom surface each extending between said first end and said second end, said terminal having an opening extending between said top surface and said bottom surface such that said opening defines said connection point, said opening being positioned adjacent to said first end;

each of said first lateral side and said second lateral side curves outwardly from an axis extending between said first end and said second end at a point being aligned with said opening;

said first lateral side has a first slot extending toward said second lateral side, said first slot being positioned between said opening and said second end; and said second lateral side has a second slot extending toward said first lateral side, said second slot being aligned with said first slot.

3. The assembly according to claim 2, wherein said curved portion includes a first bend defining a vertical portion of said terminal being perpendicularly oriented with a first horizontal portion of said terminal, said first bend being positioned between said first slot, said second slot and said second end of said terminal.

4. The assembly according to claim 3, wherein said curved portion includes a second bend defining a second horizontal portion being perpendicularly oriented with said vertical portion, said second horizontal portion lying on a plane being oriented parallel with said first horizontal portion.

5. The assembly according to claim 4, wherein said curved portion includes a curve extending between said second horizontal portion and said second end, said curve extending upwardly from said second horizontal portion.

6. The assembly according to claim 1, wherein said retainer has a primary end, a secondary end and an exterior surface extending between said primary end and said secondary end, said exterior surface having an upper side and a lower side, said retainer having an outside edge extending between said primary end and said secondary end, said outside edge having a first sidelong side and a second sidelong side, said retainer having a flap being integrated into said upper side and said lower side of said exterior surface, said flap extending upwardly from said upper side, said flap having a free end being directed toward said primary end of said retainer.

7. The assembly according to claim 6, wherein each of said first sidelong side and said second sidelong side angle outwardly between said primary end and said secondary end such that said secondary end has a width being greater than a width of said primary end.

8. The assembly according to claim 7, wherein:

said terminal has a first slot being integrated into said terminal, said terminal having a second slot being integrated into said terminal; and said retainer has a first tab extending downwardly from said first sidelong side, said first tab being positioned adjacent to said primary end, said retainer having a second tab extending downwardly from said second sidelong side, said second tab being positioned adjacent to said primary end, each of said first tab and said second tab engaging a respective one of said first slot and said second slot having said retainer sloping upwardly from said terminal.

9. The assembly according to claim 1, wherein said sheath has a front end, a back end and an outside wall extending between said front end and said back end, said outside wall being continuously arcuate about an axis extending between said front end and said back end such that said sheath has a cylindrical shape, said outer wall flaring outwardly between said front end and said back end such that said back end has a diameter being greater than a diameter of said front end.

10. The assembly according to claim 9, wherein said back end is open, said front end having a slot extending through said front end, said terminal extending through said slot having said connection point being exposed with respect to said sheath, said second end of said terminal and said secondary end of said retainer being positioned within said sheath.

11. A quick connect terminal assembly for forming an electrical connection with a conductor with being crimped, said assembly comprising:

a terminal having a connection point integrated into said terminal wherein said connection point is configured to be attached to an electrical circuit, said terminal having a curved portion being distally positioned with respect to said connection point, said terminal having a first end, a second end and an outer edge extending between said first end and said second end, said terminal being elongated between said first end and said second end, said outer edge having a first lateral side and a second lateral side, said terminal having a top surface and a bottom surface each extending between said first end and said second end, said terminal having an opening extending between said top surface and said bottom surface such that said opening defines said connection point, said opening being positioned adjacent to said first end, each of said first lateral side and said second lateral side curving outwardly from an axis extending between said first end and said second end at a point being aligned with said opening, said first lateral side having a first slot extending toward said second lateral side, said first slot being positioned between said opening and said second end, said second lateral side having a second slot extending toward said first lateral side, said second slot being aligned with said first slot, said curved portion including a first bend defining a vertical portion of said terminal being perpendicularly oriented with a first horizontal portion of said terminal, said first bend being positioned between said first slot, said second slot and said second end of said terminal, said curved portion including a second bend defining a second horizontal portion being perpendicularly oriented with said vertical portion, said second horizontal portion lying on a plane being oriented parallel with said first horizontal portion, said curved portion including a curve extending between said second horizontal portion and said second end, said curve extending upwardly from said second horizontal portion;

a retainer engaging said terminal having said retainer being spaced from said terminal to define a conductor space between said retainer and said terminal wherein said conductor space is configured to insertably receive an end of a conductor, said retainer being biased toward said terminal wherein said retainer is configured to compress the conductor between said terminal and said retainer, each of said retainer and said terminal being comprised of an electrically conductive material wherein each of said retainer and said terminal is configured to facilitate electrical communication between the conductor and the electrical circuit, said retainer having a primary end, a secondary end and an exterior surface extending between said primary end and said secondary end, said exterior surface having an upper side and a lower side, said retainer having an outside edge extending between said primary end and said secondary end, said outside edge having a first sidelong side and a second sidelong side, said retainer having a flap being integrated into said upper side and said lower side of said exterior surface, said flap extending upwardly from said upper side, said flap having a free end being directed toward said primary end of said retainer, each of said first sidelong side and said second sidelong side angling outwardly between said primary end and said secondary end such that said secondary end has a width being greater than a width of said primary end, said retainer having a first tab extending downwardly from said first sidelong side, said first tab being positioned adjacent to said primary end, said retainer having a second tab extending downwardly from said second sidelong side, said second tab being positioned adjacent to said primary end, each of said first tab and said second tab engaging a respective one of said first slot and said second slot having said retainer sloping upwardly from said terminal; and a sheath being positioned around said terminal and said retainer wherein said sheath is configured to surround the conductor when the conductor is inserted into said conductor space, said sheath being comprised of an electrically insulating material wherein said sheath is configured to inhibit electrical communication between the conductor and external objects, said sheath having a front end, a back end and an outside wall extending between said front end and said back end, said outside wall being continuously arcuate about an axis extending between said front end and said back end such that said sheath has a cylindrical shape, said outer wall flaring outwardly between said front end and said back end such that said back end has a diameter being greater than a diameter of said front end, said back end being open, said front end having a slot extending through said front end, said terminal extending through said slot having said connection point being exposed with respect to said sheath, said second end of said terminal and said secondary end of said retainer being positioned within said sheath.

12. The assembly according to claim 11, wherein said first end of said terminal has a slot extending toward said second end of said terminal wherein said slot in said first end is configured to accommodate a post of an electrical connection.

13. The assembly according to claim 11, wherein said first end of said terminal is flattened into a spade wherein said spade is configured to be inserted into a female electrical connection.

14. The assembly according to claim 11, wherein said terminal curls onto said to said top surface along each of said first lateral side and said second lateral side of said outer edge of said terminal at a point located adjacent to said first end of said terminal wherein said first end of said terminal is configured to slidably receive a spade of an electrical connection.

* * * * *